US008503904B2

(12) United States Patent
Okuno

(10) Patent No.: US 8,503,904 B2
(45) Date of Patent: Aug. 6, 2013

(54) DEVELOPING DEVICE, IMAGING UNIT AND IMAGE FORMING APPARATUS

(75) Inventor: Yuusuke Okuno, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 254 days.

(21) Appl. No.: 13/048,577

(22) Filed: Mar. 15, 2011

(65) Prior Publication Data

US 2011/0229189 A1 Sep. 22, 2011

(30) Foreign Application Priority Data

Mar. 16, 2010 (JP) ..... 2010-059356

(51) Int. Cl.
*G03G 15/09* (2006.01)

(52) U.S. Cl.
USPC ..... 399/104

(58) Field of Classification Search
USPC ..... 399/104, 105, 103
See application file for complete search history.

(56) References Cited

U.S. PATENT DOCUMENTS 7,092,656 B2 * 8/2006 Yokokawa ..... 399/104
7,761,028 B2 * 7/2010 Oguma et al. ..... 399/104

FOREIGN PATENT DOCUMENTS

JP 6-110306 4/1994
JP 2004-354854 12/2004
JP 2008-164942 7/2008

OTHER PUBLICATIONS

Notification of Reasons for Refusal mailed Feb. 7, 2012, directed to Japanese Patent Application No. 2010-059356; 6 pages.

* cited by examiner

*Primary Examiner* — Sophia S Chen
(74) *Attorney, Agent, or Firm* — Morrison & Foerster LLP

(57) ABSTRACT

A developing device develops a latent image on an image carrier by using a developer. The device includes a developer carrier that faces the image carrier and is configured to rotate while magnetically holding developer on its outer circumferential surface. The device also includes a magnetic member elongated along a rotational direction of the developer carrier to form a gap that surrounds the outer circumferential surface. The magnetic member overlaps an end of a developing region in a direction of a rotational axis of the developer carrier, when viewed from a direction perpendicular to the rotational axis. When a side of the magnetic member close to a center of the developer carrier is divided into first and second sides and located downstream and upstream in the rotational direction, respectively, the first side is set back further from the center than a position where the first and second sides meet.

14 Claims, 13 Drawing Sheets

DEVELOPING DEVICE, IMAGING UNIT AND IMAGE FORMING APPARATUS

This application is based on applications No. 2010-059356 filed in Japan, the contents of which are hereby incorporated by reference.

BACKGROUND OF THE INVENTION (1) Field of the Invention

The present invention relates to a developing device, an imaging unit and an image forming apparatus for developing a latent image on an image carrier with use of developer.

(2) Related Art

A developing device including a housing, a developing roller as a developer carrier, and so on is known as a developing device in an image forming apparatus such as a copying machine. The housing contains therein powdery developer including particles with magnetic properties, and has an opening at a side facing a photosensitive drum as an image carrier. The developing roller is provided at the opening of the housing, and rotates to convey the developer while holding the developer on an outer circumferential surface thereof.

One problem of such a developing device using the powdery developer is that there are toner particles moving away from the developing roller without being provided for development and floating around the developing roller, although the amount thereof is small. Once the floating toner is carried by air currents in the device and leaks from axial ends of the developing roller to the outside of the housing, the leaking toner is likely to make an interior of the apparatus dirty. The developer can also leak from the axial ends of the developing roller to the outside of the housing.

In order to address the above-mentioned problem, there has been used a structure in which a magnetic member elongated along a rotational direction of the developing roller is provided so as to surround an outer circumferential surface of each axial end portion of the developing roller with a predetermined gap therebetween. With this structure, a magnetic blush of the developer is generated between the developing roller and the magnetic member. As the generated magnetic blush serves as a barrier, the floating toner or the developer is prevented from leaking to the outside.

In the art of an image forming apparatus, there is a strong demand for miniaturization of an image forming apparatus. This includes reduction of a length of a developing roller in a developing device in an axial direction.

A developing width of the developing roller (a length of an effective developing region in the axial direction of the developing roller) is determined in advance based on a maximum paper size and so on, and thus it is impossible to reduce the developing width. Therefore, it is required to reduce a length of a region other than the effective developing region in the axial direction of the developing roller.

For example, the developing roller is made longer than the developing width to provide, at each end portion thereof, the magnetic member for generating a magnetic blush between each axial end portion of the developing roller and the magnetic member. By reducing the lengthened part of the developing roller, the length of the developing roller itself can be reduced.

However, the reduction of the lengthened part of the developing roller means reduction of the width of the magnetic member in the axial direction of the developing roller. If the width of the magnetic member is reduced, a width of a region where the magnetic blush is generated throughout the magnetic member is also reduced. With this structure, leaking of the floating toner might not be prevented.

SUMMARY OF THE INVENTION

The present invention aims to provide a developing device that prevents the leaking of the floating toner by using a magnetic member and can be small in size. The present invention also aims to provide an imaging unit and an image forming apparatus including the developing device.

In order to achieve the above aim, one aspect of the present invention is a developing device that develops a latent image on an image carrier with use of developer including particles with magnetic properties, the developing device comprising: a developer carrier that is provided so as to face the image carrier, and configured to rotate while magnetically holding the developer on an outer circumferential surface thereof; and a magnetic member that is elongated along a rotational direction of the developer carrier so as to surround the outer circumferential surface of the developer carrier with a gap therebetween, wherein when viewed from a direction perpendicular to a rotational axis of the developer carrier, the magnetic member overlaps an end of a developing region of the developer carrier in a direction of the rotational axis, and when a side of the magnetic member close to a center of the developer carrier in the direction of the rotational axis is divided into a first side located downstream in the rotational direction and a second side located upstream in the rotational direction, the first side is set back further from the center of the developer carrier than a position where the first and second sides meet each other.

In order to achieve the above aim, another aspect of the present invention is an imaging unit that is detachable from a body of an image forming apparatus, comprising: an image carrier on which a latent image is formed; and a developing unit configured to develop the latent image with use of developer including particles with magnetic properties, wherein the developing unit includes: a developer carrier that is provided so as to face the image carrier, and configured to rotate while magnetically holding the developer on an outer circumferential surface thereof; and a magnetic member that is elongated along a rotational direction of the developer carrier so as to surround the outer circumferential surface of the developer carrier with a gap therebetween, when viewed from a direction perpendicular to a rotational axis of the developer carrier, the magnetic member overlaps an end of a developing region of the developer carrier in a direction of the rotational axis, and when a side of the magnetic member close to a center of the developer carrier in the direction of the rotational axis is divided into a first side located downstream in the rotational direction and a second side located upstream in the rotational direction, the first side is set back further from the center of the developer carrier than a position where the first and second sides meet each other.

In order to achieve the above aim, the other aspect of the present invention is an image forming apparatus that includes a developing unit for developing a latent image on an image carrier with use of developer including particles with magnetic properties, wherein the developing unit includes: a developer carrier that is provided so as to face the image carrier, and configured to rotate while magnetically holding the developer on an outer circumferential surface thereof; and a magnetic member that is elongated along a rotational direction of the developer carrier so as to surround the outer circumferential surface of the developer carrier with a gap therebetween, when viewed from a direction perpendicular to a rotational axis of the developer carrier, the magnetic member overlaps an end of a developing region of the developer carrier in a direction of the rotational axis, and when a side of the magnetic member close to a center of the developer carrier in the direction of the rotational axis is divided into a first side located downstream in the rotational direction and a second side located upstream in the rotational direction, the first side is set back further from the center of the developer carrier than a position where the first and second sides meet each other.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the Drawings.

Figure 6:
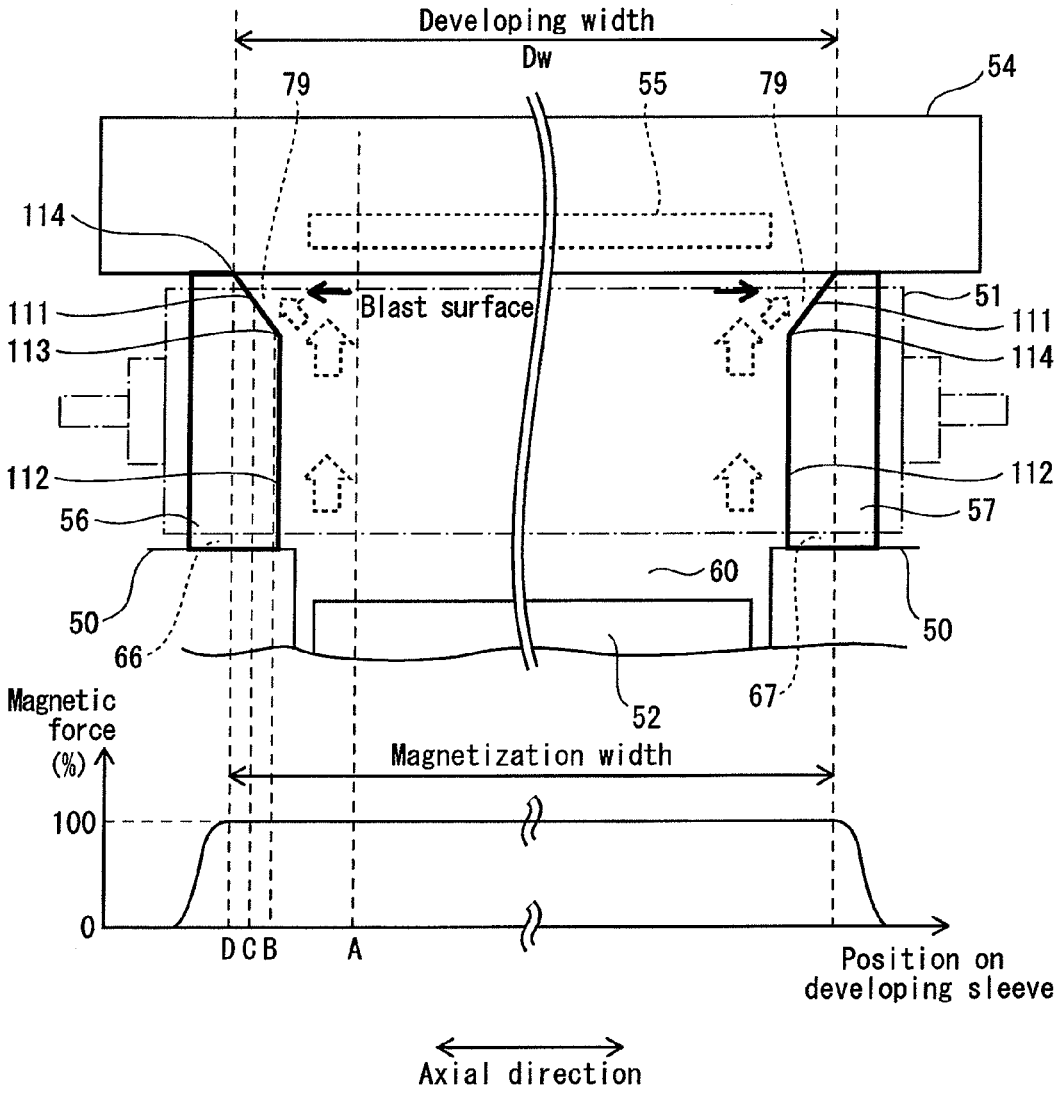
FIG. 6 schematically shows positional relations among a developing roller, magnetic members and a restriction member in an axial direction of the developing roller, when viewed along a direction of an arrow Y shown in FIG. 4.
Figure 7A:
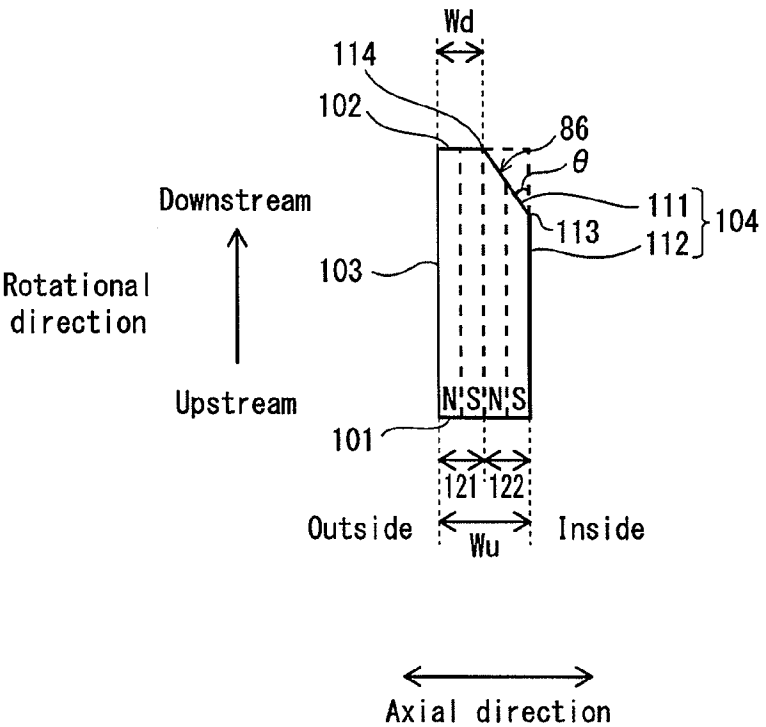
Figure 7B:
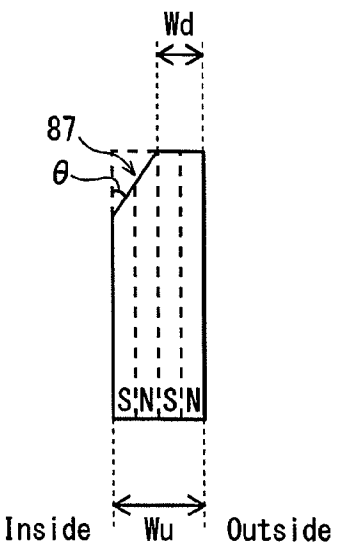
Figure 7C:
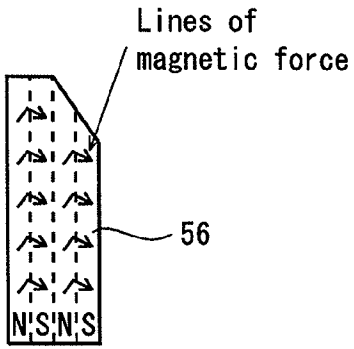
Figure 8:
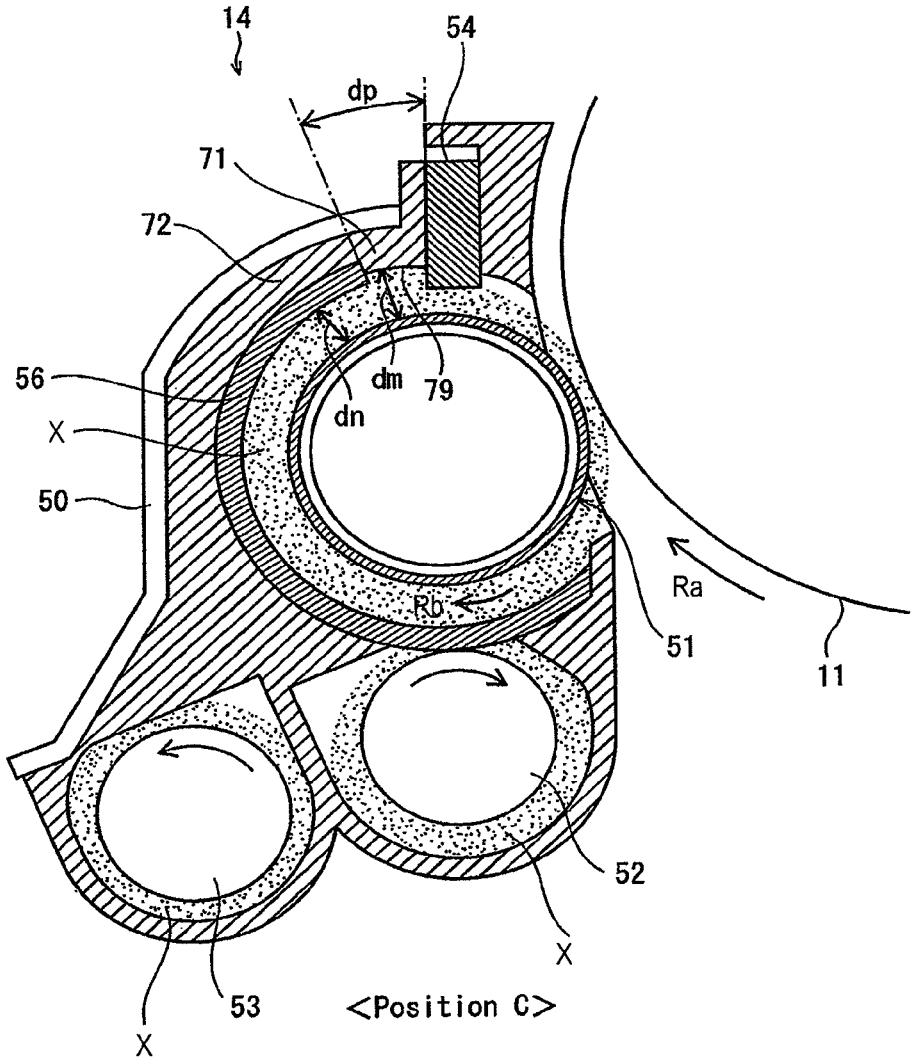
Figure 9:
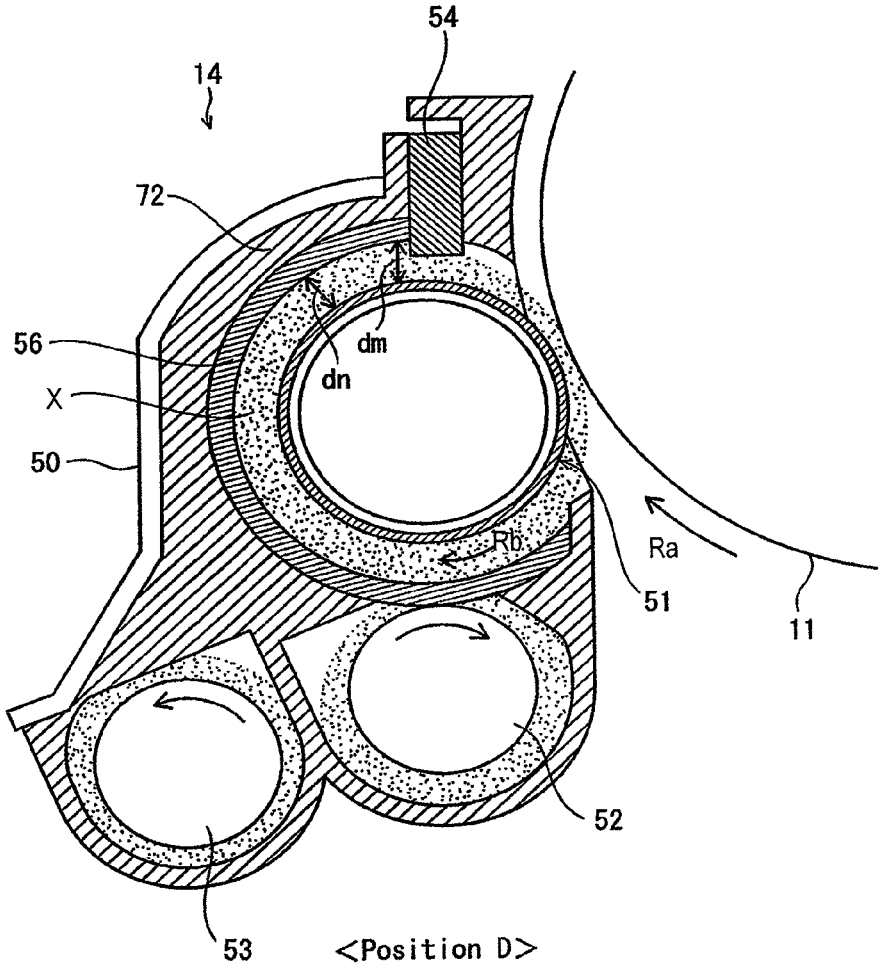
Figure 10A:
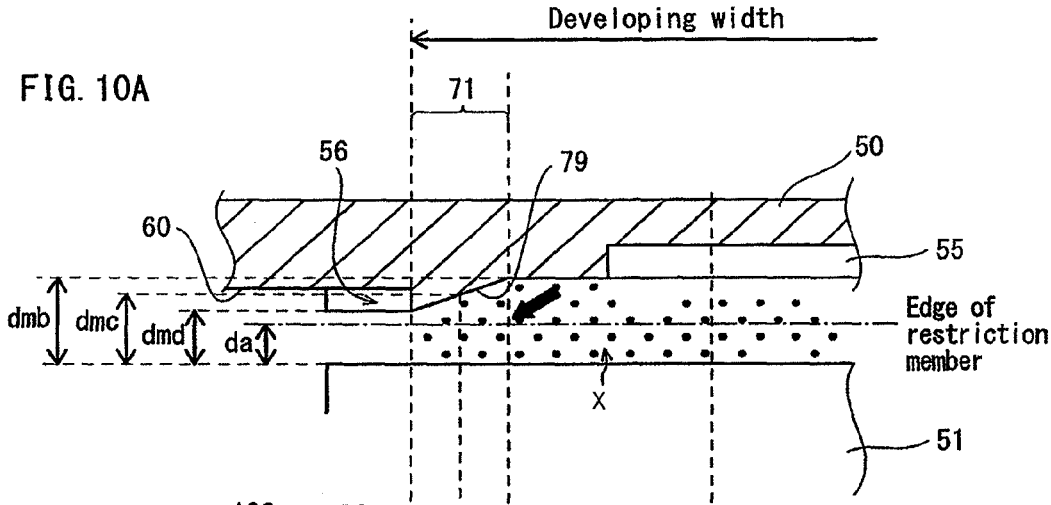
Figure 10B:
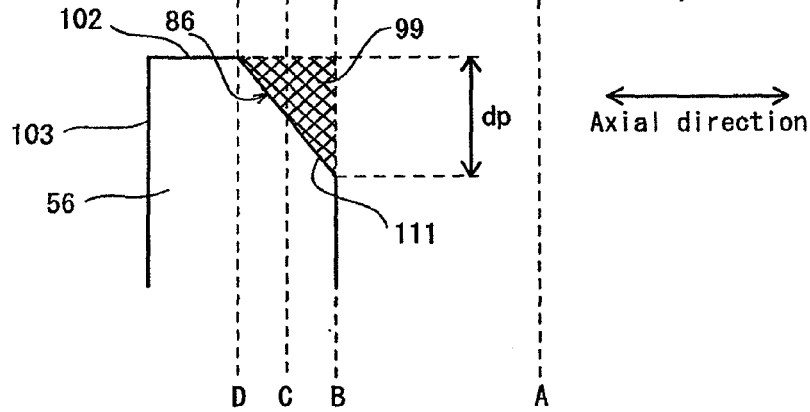
Figure 11A:
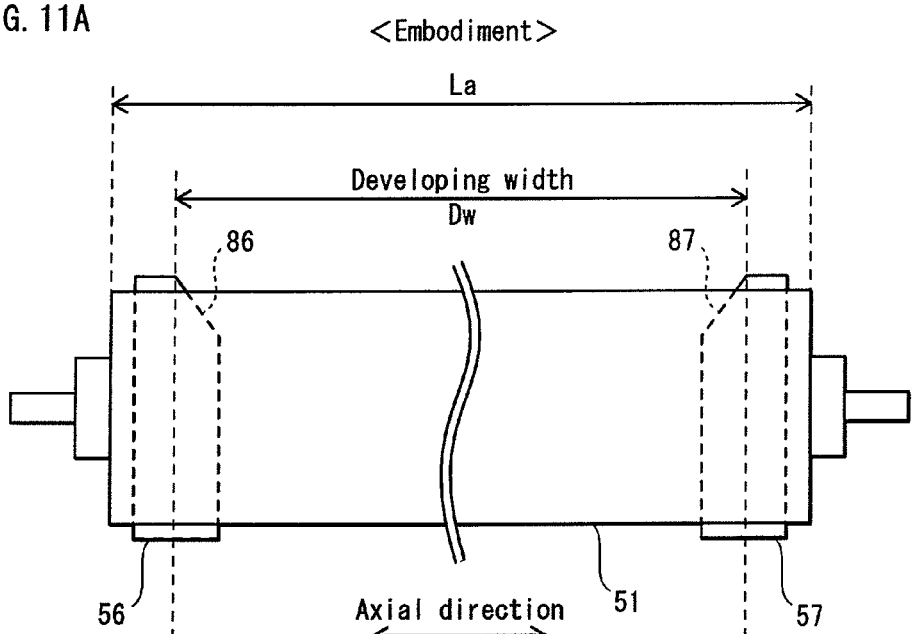
Figure 11B:
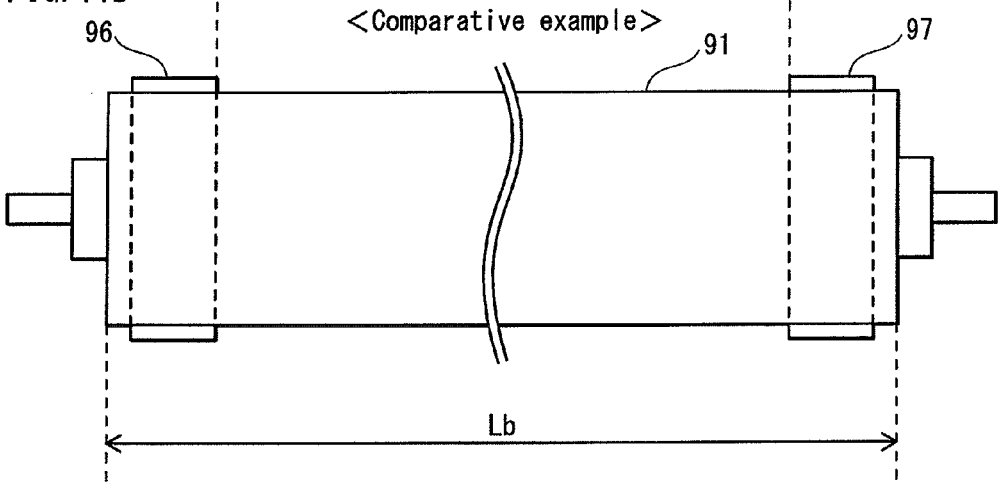
Figure 12A:
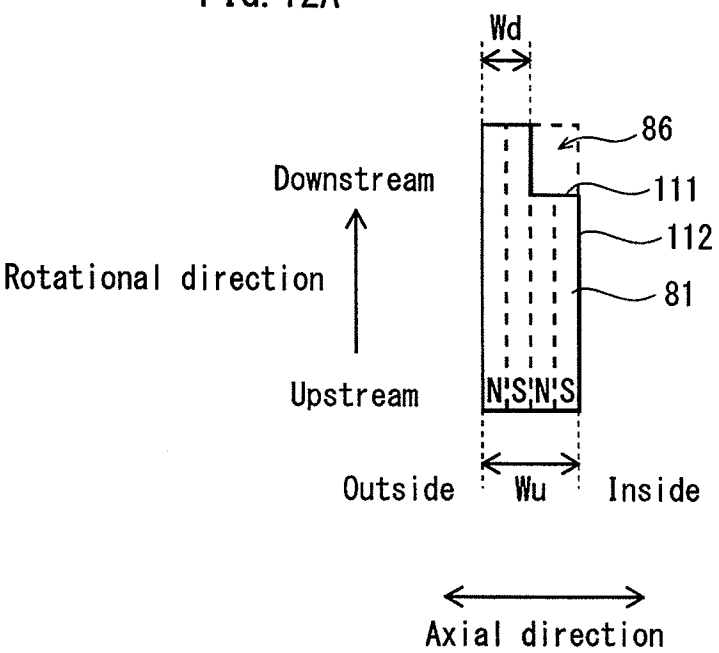
Figure 12B:
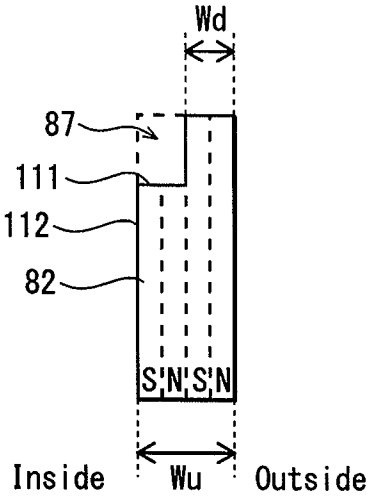
Figure 13A:
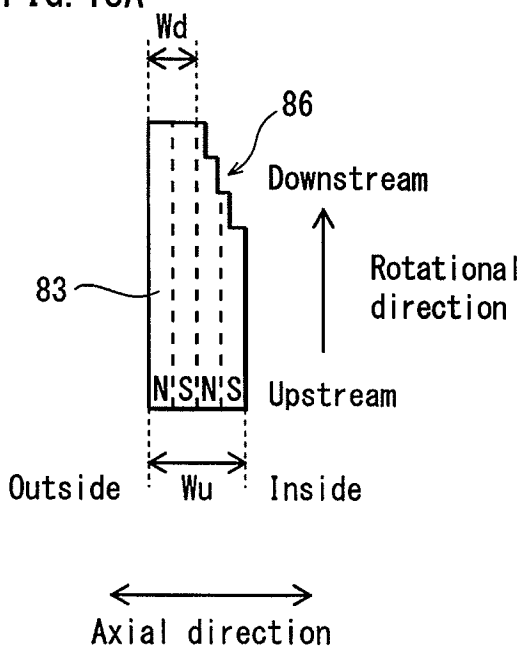
Figure 13B:
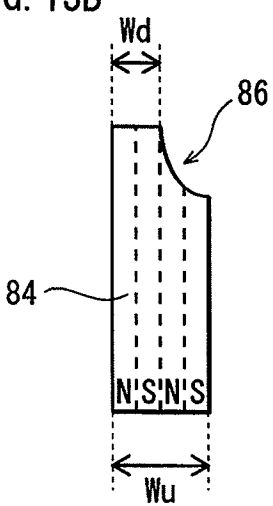
Figure 13C:
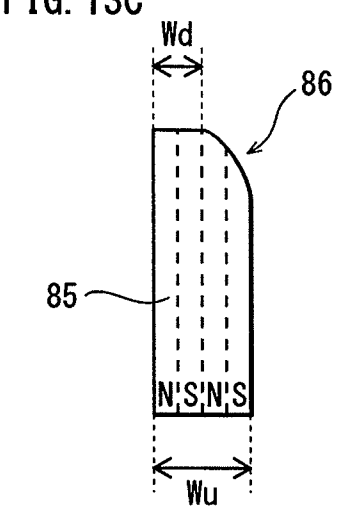

Each of FIGS. 7A, 7B and 7C is a plan view showing a structure of the magnetic member;

FIG. 8 is a cross sectional view of the developing unit at a position C shown in FIG. 6;

FIG. 9 is a cross sectional view of the developing unit at a position D shown in FIG. 6;

FIGS. 10A and 10B each show a change of a distance dm between a circular surface of the housing and an outer circumferential surface of the developing roller in the axial direction of the developing roller;

Each of FIGS. 11A and 11B is a schematic view showing a positional relation among a developing width Dw and the magnetic members in the axial direction of the developing roller;

Each of FIGS. 12A and 12B is a plan view showing a structure of a magnetic member in modification; and Each of FIGS. 13A, 13B and 13C is a plan view showing a structure of a magnetic member in modification.

DESCRIPTION OF PREFERRED EMBODIMENTS

The following describes an example in which a developing device, and an imaging unit and an image forming apparatus in an embodiment of the present invention are applied to a tandem-type color digital printer (hereinafter, referred to simply as a "printer"), with reference to the drawings.

<Overall Structure of Printer>

Figure 1:
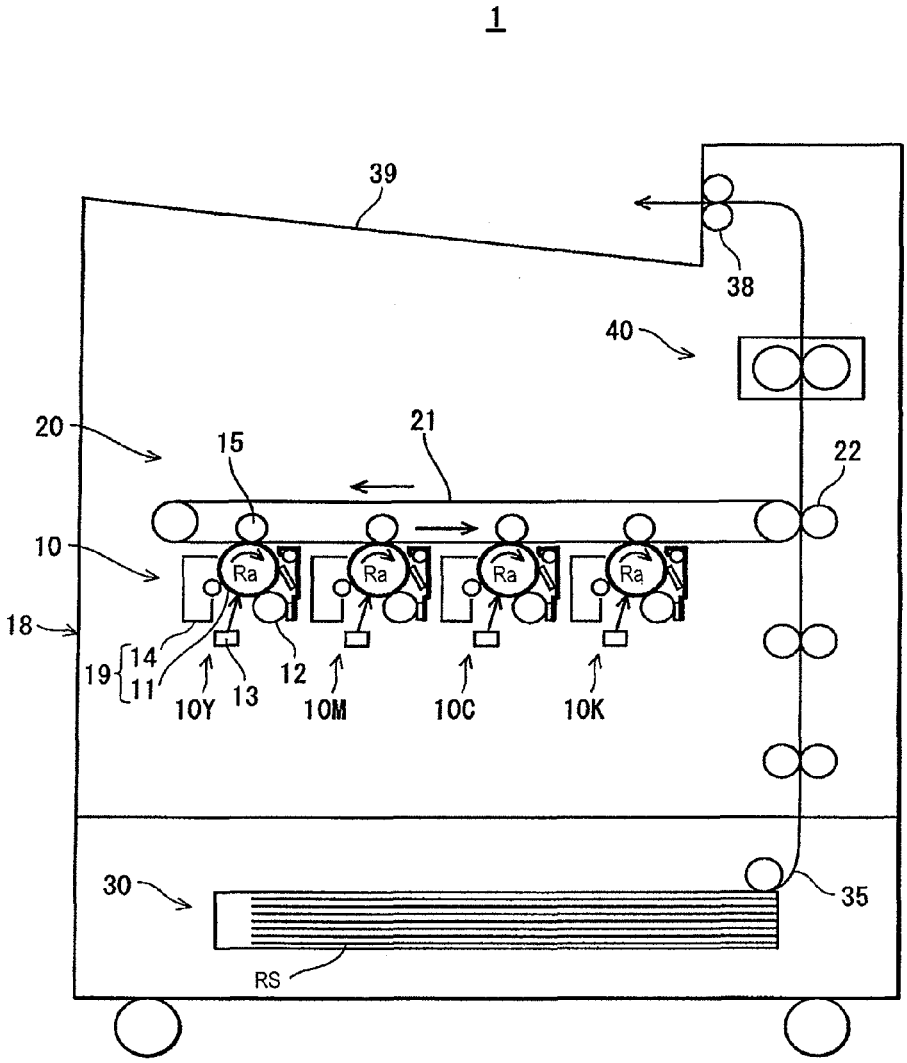
FIG. 1 shows an overall structure of a printer.

FIG. 1 shows an overall structure of a printer 1.

As shown in FIG. 1, the printer 1 forms an image in a well-known electrophotographic method. The printer 1 includes an image processing unit 10, an intermediate transfer unit 20, a feeder 30, a fixing unit 40 and so on. Upon receiving an instruction for executing a print job from an external terminal device (not illustrated) via a network (e.g. LAN), the printer 1 forms an image of yellow (Y), magenta (M), cyan (C) and black (K) colors in accordance with the received instruction.

The image processing unit 10 includes image forming units 10Y, 10M, 10C and 10K respectively corresponding to Y, M, C and K colors. The image forming unit 10Y includes a photosensitive drum 11, a charger 12, an exposure-scanning unit 13, a developing unit 14, a primary transfer roller 15, a cleaner for cleaning the photosensitive drum 11 and so on. The photosensitive drum 11 rotates in a direction of an arrow Ra, and the other units are positioned around the photosensitive drum 11. By performing well-known charging, exposure-scanning and developing steps, the image forming unit 10Y forms an electrostatic latent image on the photosensitive drum 11, and the formed electrostatic image is developed with use of toner of Y color to form a toner image of Y color. Here, the developing unit 14 is filled with two-component developer, as developer for Y color, including carrier and toner.

Each of the other image forming units 10M, 10C and 10K basically has a similar structure to the structure of the image forming unit 10Y. The developing unit 14 in each of the image forming units 10M, 10C and 10K is filled with developer for a corresponding color, and a toner image of the corresponding color is formed on the photosensitive drum 11 by development. Note that reference signs of units included in the image forming units 10M, 10C and 10K are omitted from FIG. 1.

In this embodiment, in units constituting the image forming unit such as the photosensitive drum 11, the charger 12 and the cleaner, the photosensitive drum 11 and the developing unit 14 are unitized as an imaging unit 19. The imaging unit 19 is configured to be detachable from a device body 18 in a unit so as to be replaceable during maintenance or the like.

The intermediate transfer unit 20 includes an intermediate transfer belt 21 running around in a direction of arrows shown in FIG. 1.

The feeder 30 feeds recording sheets RS one by one from a paper feeding cassette into a conveyance path 35.

A toner image formed on the photosensitive drum 11 in each of the image forming units 10Y, 10M, 10C and 10K is primarily-transferred onto the running intermediate transfer belt 21 at a transfer position of the photosensitive drum 11 upon receiving an electrostatic force exerted by an electric field generated between the primary transfer roller 15 and the photosensitive drum 11. At this time, an imaging operation of each color is performed at a different timing so that toner images are superimposed onto one another at the same position of the intermediate transfer belt 21.

The sheet RS is fed by the feeder 30 in synchronization with a timing at which the imaging operations are performed. The conveyed sheet RS is sandwiched between the intermediate transfer belt 21 and a secondary transfer roller 22 pressed against the intermediate transfer belt 21. Upon receiving an electrostatic force exerted by an electric field generated by a secondary transfer voltage applied by the secondary transfer roller 22, the toner images on the intermediate transfer belt 21 are collectively secondarily-transferred onto the sheet RS. After the secondary transfer, the sheet RS is conveyed to the fixing unit 40.

The fixing unit 40 fixes the secondary-transferred toner images on the sheet RS by heat and pressure. The sheet RS after fixing is ejected via a pair of ejection roller 38 to the outside, and received by an ejection tray 39.

<Structure of Developing Unit 14>

Figure 2:
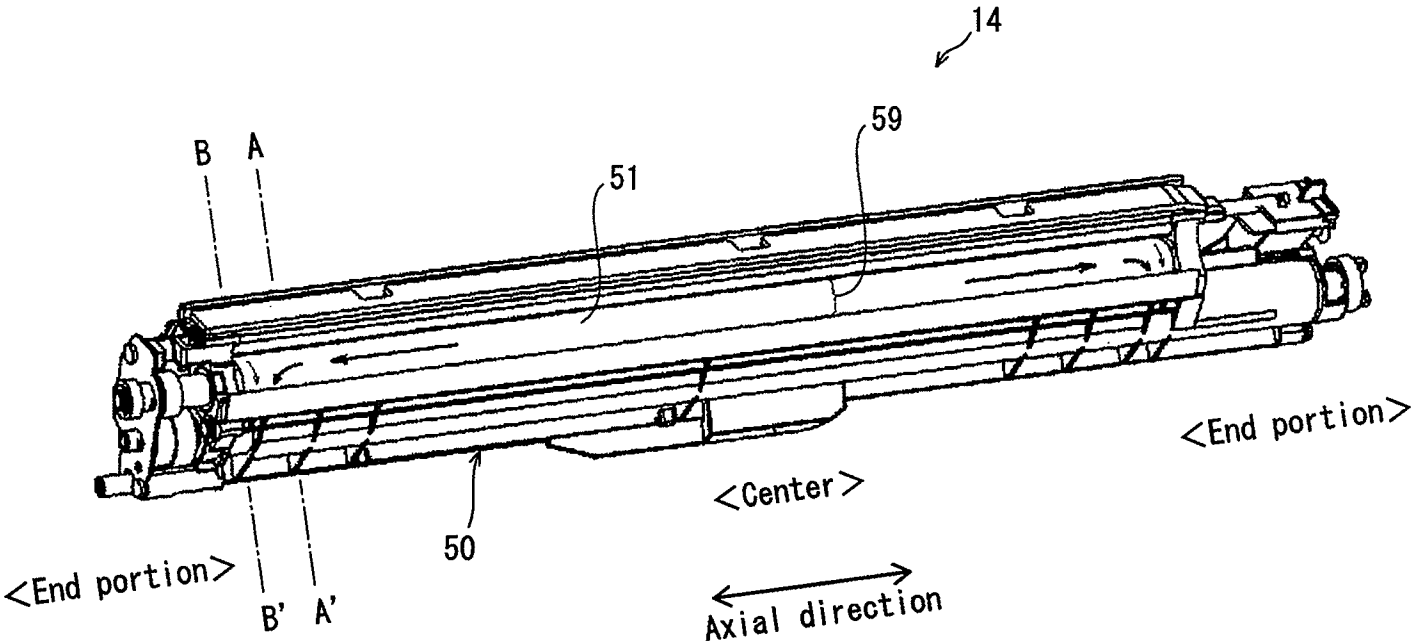
FIG. 2 is a schematic perspective view showing a structure of a developing unit in the printer.

FIG. 2 is a schematic perspective view showing a structure of the developing unit 14 in the image forming unit 10Y. FIG.

Figure 4:
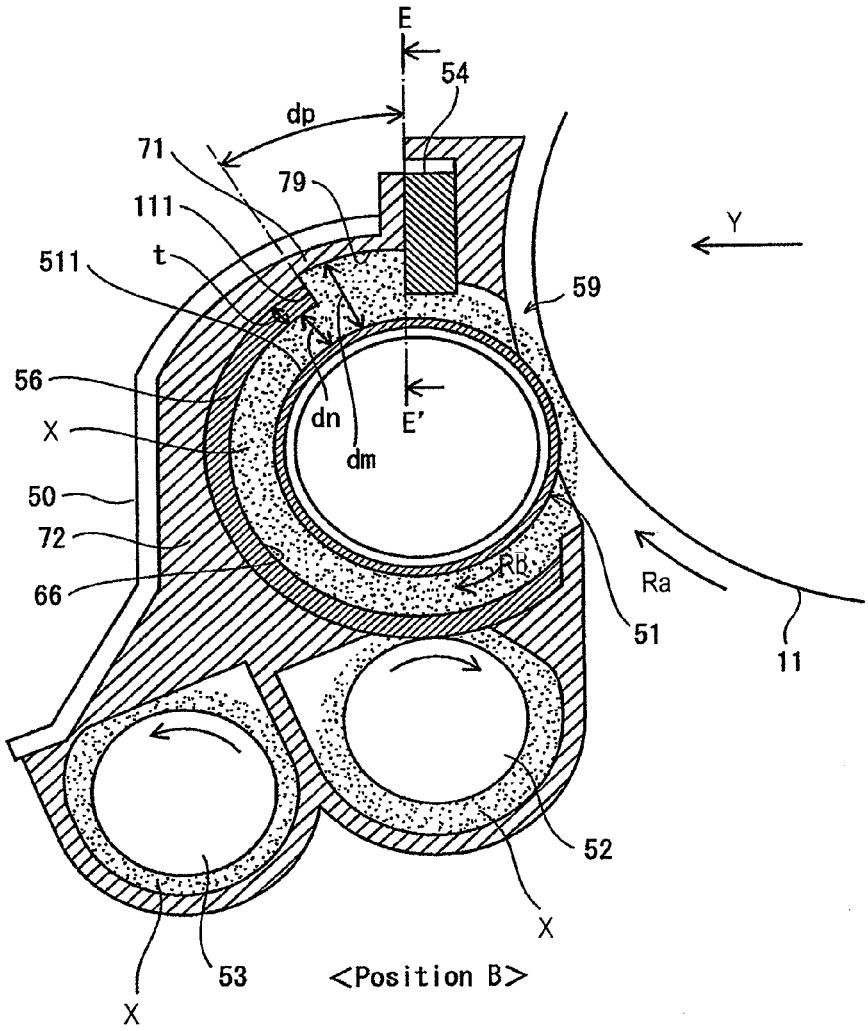
FIG. 4 is a cross sectional view of the developing unit taken along the line B-B' of FIG. 2.

3 is a cross sectional view of the developing unit 14 taken along the line A-A' of FIG. 2. FIG. 4 is a cross sectional view of the developing unit 14 taken along the line B-B' of FIG. 2. Explanation about the structure of the developing unit 14 in each of the other image forming units 10M, 10C and 10K is omitted here, because it is similar to the structure of the developing unit 14 in the image forming unit 10Y.

Figure 3:
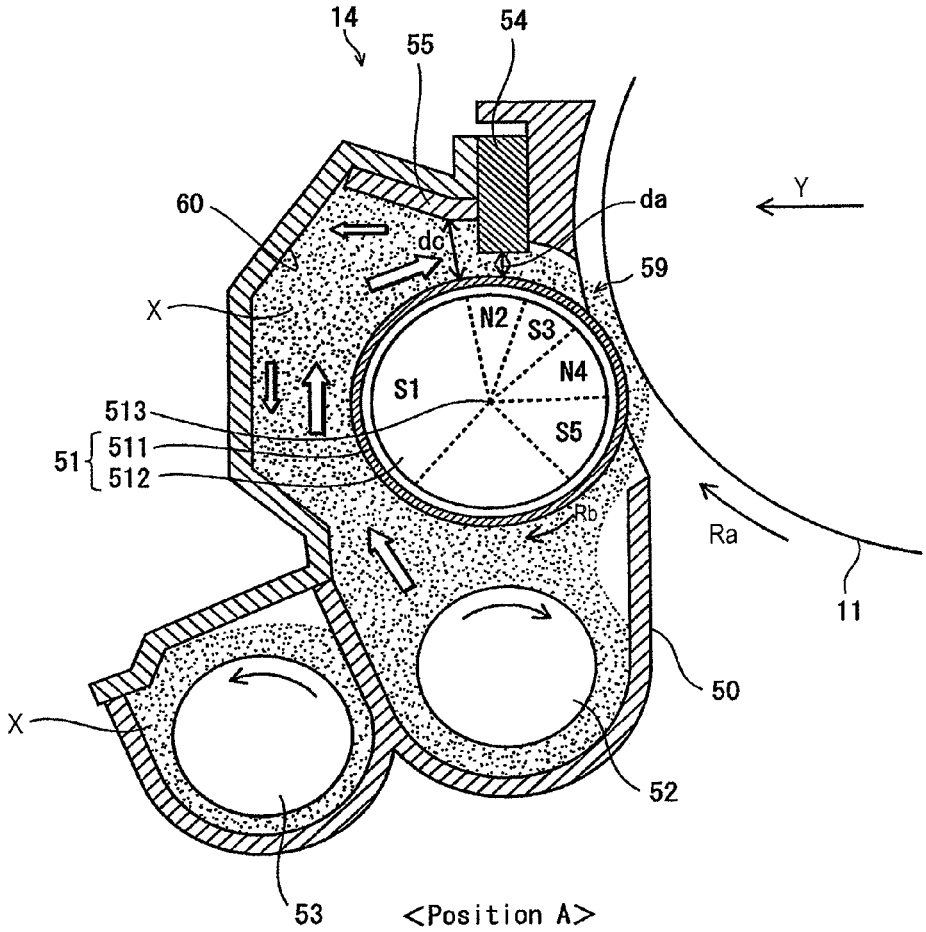
FIG. 3 is a cross sectional view of the developing unit taken along the line A-A' of FIG. 2.

As shown in FIGS. 2, 3 and 4, the developing unit 14 includes a housing 50, a developing roller 51, a supply member 52, a stirring member 53, a restriction member 54, a return member 55, magnetic members 56 and 57 (see FIG. 6) and so on. The developing roller 51, the supply member 52, the stirring member 53, the restriction member 54, the return member 55 and the magnetic members 56 and 57 are housed in the housing 50.

Each of the developing roller 51, the supply member 52, the stirring member 53 and the restriction member 54 is elongated in a direction of a rotational axis 513 of the developing roller 51 (in a direction perpendicular to the sheet of FIGS. 3 and 4).

The housing 50 contains therein two-component developer (hereinafter, referred to as "developer") X including carrier as particles with magnetic properties and toner.

The developing roller 51 is driven to rotate in a direction of an arrow Rb. The housing 50 has an opening 59 at a side facing a photosensitive drum 11, and the developing roller 51 is provided at the opening 59 with a predetermined gap of, for example, 1 [mm] with an outer circumferential surface of the photosensitive drum 11. Note that hereinafter a rotational direction of the developing roller 51 is referred to as a roller rotational direction, and a direction parallel to the rotational axis 513 of the developing roller 51 is referred to as a roller axial direction.

The developing roller 51 includes a cylindrical developing sleeve 511 (see FIG. 3) and a magnet roller 512 (see FIG. 3) inserted into the developing sleeve 511 along the roller axial direction.

The magnet roller 512 has magnetic poles of S1, N2, S3, N4 and so on arranged in a circumferential direction thereof. The magnet roller 512 is fixed to the housing 50 at both ends in the roller axial direction so as not to rotate.

Here, in the magnetic poles, the magnetic pole N2 is positioned so as to virtually face the restriction member 54. The magnetic pole S1 is positioned further upstream than the magnetic pole N2 in the roller rotational direction, whereas the magnetic pole N4 is positioned further downstream than the magnetic pole N2 in the roller rotational direction. The magnetic pole N4 is configured to face the photosensitive drum 11 via the opening 59.

Each of the magnetic poles extends along the roller axial direction. The length of the magnetic pole N4 in the roller axial direction (magnetization width) is equal to the length of a developing region in the roller axial direction (developing width). Note that the reference signs showing the magnetic poles are omitted from the figures other than FIG. 3.

The developing sleeve 511 is made of a non magnetic material such as aluminum. Blasting is performed over an area of an outer circumferential surface of the developing sleeve 511. The area has a width equal to the developing width in the roller axial direction.

The developing sleeve 511 is partially exposed from the opening 59 of the housing 50 so as to face the photosensitive drum 11, and rotatably held in the housing 50. Upon receiving a driving force applied by a driving unit (not illustrated) such as a motor, the developing sleeve 511 rotates around the stationary magnet roller 512 in the roller rotational direction.

The supply member 52 is a screw located below the developing roller 51. The supply member 52 supplies the developer X to the developing roller 51 while rotating in a direction of an arrow shown in FIG. 3.

The stirring member 53 is a screw arranged along the supply member 52. The stirring member 53 stirs the developer X contained in the housing 50 while rotating in a direction of an arrow shown in FIG. 3 to prevent the developer X from solidifying and to maintain liquidity, and conveys the stirred developer X to the supply member 52.

The restriction member 54 is plate-like. The restriction member 54 is positioned such that an edge of the restriction member 54 has a gap of a predetermined distance da with an outer circumferential surface of the developing sleeve 511. The restriction member 54 restricts the amount of developer X passing through the gap. The predetermined distance da is for example 0.4 [mm]. The length of the restriction member 54 in the roller axial direction is substantially equal to or greater than the length of the developing roller 51 in the roller axial direction.

The return member 55, as shown in FIG. 3, is provided on a part of an inner surface 60 (a surface facing the developing sleeve 511) of the housing 50 positioned further upstream than the restriction member 54 in the roller rotational direction and adjacent to the restriction member 54. The return member 55 is provided so as to face an outer circumferential surface of the developing sleeve 511 with a gap having a predetermined distance dc of, for example, 2 [mm]. The return member 55 increases pressure applied to the developer X flowing toward the restriction member 54. The return member 55 also returns the developer X, which is restricted by the restriction member 54 and thus does not pass through the gap between the restriction member 54 and the outer circumferential surface of the developing sleeve 511, to the supply member 52 along the inner surface 60 of the housing 50. Note that the length of the return member 55 in the roller axial direction is less than the developing width, and thus the return member 55 does not exist at portions corresponding to both end portions of the developing roller 51.

<Structures of Magnetic Members 56 and 57>

Each of magnetic members 56 and 57 is a magnetic sealing member made of a flexible rubber magnet sheet. An outer surface of each of the magnetic members 56 and 57 has a magnetic force of, for example, 10 to 50 [mT]. Each of the magnetic members 56 and 57 has a thickness t of, for example, 0.4 to 0.6 [mm] thick. Each of the magnetic members 56 and 57 is provided so as to face an end portion of the developing sleeve 511 in the roller axial direction.

Magnetic blushes of the developer are generated between the magnetic member 56 and one end portion of the developing sleeve 511, and between the magnetic member 57 and the other end portion of the developing sleeve 511. By serving as barriers, the generated magnetic blushes prevent toner floating around the developing roller 51 without being provided for development from being carried by air currents (e.g. the air currents flowing in a direction of arrows shown in FIG. 2) in the device along the roller axial direction and leaking from axial ends of the developing sleeve 511 to the outside of the housing 50. The generated magnetic blushes also prevent the developer from leaking from the axial ends of the developing sleeve 511 to the outside.

In particular, as shown in FIG. 4, the magnetic member 56 is provided on a curved portion 72 of the housing 50 having a circular surface 66 whose center of curvature is identical to a center of the developing sleeve 511. The magnetic member 56 is provided so as to face an end portion of the developing roller 51 with a gap having a predetermined distance dn from an outer circumferential surface of the developing sleeve 511, and extends along the outer circumferential surface of the developing sleeve 511 in the roller rotational direction. The predetermined distance dn is for example 1 [mm].

Figure 5:
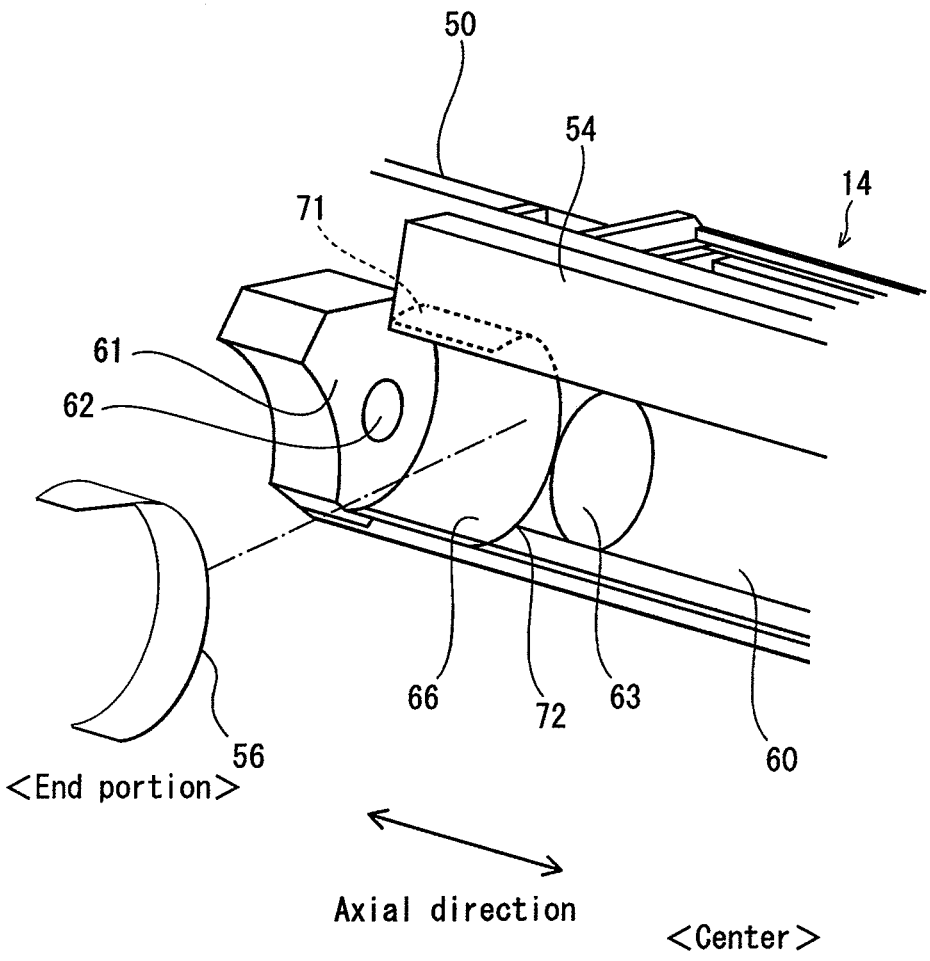
FIG. 5 is a schematic perspective view showing a shape of a part of an inner surface of a housing in the developing unit.

FIG. 5 is a schematic perspective view showing a structure of the circular surface 66 of housing 50. In order to increase intelligibility of the structure of the circular surface 66, a part of the housing 50, the developing roller 51, the supply member 52 and so on are omitted from FIG. 5.

As shown in FIG. 5, the circular surface 66 is formed at an end portion of the housing 50 in the roller axial direction. The circular surface 66 is adjacent to a supporting portion 61 at a side close to a center of the developing unit 14 in the roller axial direction. The supporting portion 61 has a shaft bearing 62 for supporting a shaft of the developing roller 51. A reference sign 63 in FIG. 5 indicates a hole into which the supply member 52 is inserted.

The magnetic member 56 is elongated in the roller rotational direction, and attached to the circular surface 66 with a double-faced tape. Although FIG. 5 shows only one end portion of the housing 50 in the roller axial direction, a circular surface 67 (see FIG. 6) having a similar shape to the circular surface 66 is formed at the other end portion of the housing 50. A magnetic member 57 is attached to the circular surface 67 so as to have the predetermined distance dn from the outer circumferential surface of the developing sleeve 511.

Note that a method for providing the magnetic members 56 and 57 to the housing 50 is not limited to the attachment with use of a double-faced tape. For example, they may be attached to the housing 50 with an adhesive agent, may be screwed to the housing 50 or may be provided in another manner. The magnetic members 56 and 57 are not limited to rubber sheets, and may be made of other materials containing a magnet. Furthermore, although a center of curvature of the circular surfaces 66 and 67 is identical to the center of the developing sleeve 511 in this embodiment, the structures of the circular surfaces 66 and 67 are not limited to this.

FIG. 6 schematically shows positional relations among the developing roller 51, the magnetic members 56 and 57 and the restriction member 54 in the roller axial direction, when viewed along a direction of an arrow Y shown in FIG. 4. FIG. 6 also shows a graph illustrating a relation between the magnetization width and distribution of a magnetic force in the roller axial direction. FIG. 7A is a plan view showing the structure of the magnetic member 56. FIG. 7B is a plan view showing the structure of the magnetic member 57. FIG. 7C schematically shows directions of lines of a magnetic force of the magnetic member 56. Note that, for the sake of simplicity, the magnetic members 56 and 57 are seen through the developing roller 51 shown by a dotted and dashed line in FIG. 6.

As shown in FIG. 6, the magnetic member 56 is provided so as to correspond to and overlap an end of the developing region having the developing width Dw in the roller axial direction. The magnetic member 57 is provided so as to correspond to and overlap the other end of the developing region in the roller axial direction.

As set forth the above, blasting is performed over a part of the outer circumferential surface of the developing sleeve 511 having a width equal to the developing width. Therefore, each of the magnetic members 56 and 57 is provided so as to overlap the part of the outer circumferential surface of the developing sleeve 511 in which the blasting has been performed in the roller axial direction.

In a plan view, the magnetic members 56 and 57 are elongated along the roller rotational direction, and respectively have cut-out portions 86 and 87. Each of the cut-out portions 86 and 87 is formed by diagonally cutting out, from a rectangle, a corner located downstream in the roller rotational direction and close to the center of the developing roller 51 (inside) in a straight line. The cut-out portions 86 and 87 are formed to reduce the length of the developing roller 51 in an axial direction, thereby reducing the size of a device (the developing unit 14). Details therefor are described later.

Here, as shown in FIG. 7, a side of each magnetic member close to the center of the developing roller 51 in the roller axial direction is also referred to as an "inside", whereas the other side of each magnetic member far from the center of the developing roller 51 in the roller axial direction (a side close to an overlapped end of the developing roller 51) is also referred to as an "outside". Also, "upstream in the roller rotational direction" and "downstream in the roller rotational direction" are abbreviated as "upstream" and "downstream", respectively.

As shown in FIG. 7A, an outline of the magnetic member 56 includes a front side 101 located upstream, a rear side 102 located downstream, a side 103 located outside in the roller axial direction, and a side 104 located inside in the roller axial direction.

The front side 101 and the rear side 102 are each parallel to the roller axis, whereas the side 103 is perpendicular to the roller axis (is parallel to the roller rotational direction). Note that, since FIG. 7A is a plan view showing a structure of the magnetic member 56, the side 103 is shown in a straight line. When the magnetic member 56 is attached to the housing 50, the side 103 is curved along the roller rotational direction. The same applies to the side 104.

The side 104 bends to form an angle at the cut-out portion 86. The side 104 is divided into a first side 111 corresponding to an edge of the cut-out portion 86 and a second side 112 continuing the first side 111 and being located further upstream than the first side 111. The second side 112 is a straight line perpendicular to the roller axis. Whereas the first side 111 is a straight line forming an acute angle θ with the second side 112 at a point 113 where the first side 111 and the second side 112 meet each other. In other words, the first side 111 is set back further from the center of the developing roller 51 than the point (position) 113 relative to the second inner side 112.

Here, the angle θ is for example 45[°]. It is desirable that the angle θ fall within a range of 45±10 [°] (i.e. a range of 35 to 55[°]).

As shown in FIG. 6, the magnetic member 56 is provided such that a point 114 where the first side 111 and the rear side 102 meet each other is on an end of the developing region in the roller axial direction.

As shown in FIGS. 7A, 7B and 7C, the magnetic member 56 is formed by alternately arranging N-pole regions and S-pole regions in the roller axial direction by magnetization or the like. Each of the N-pole and S-pole regions is elongated along the roller rotational direction. FIG. 7C shows directions of lines of a magnetic force generated from an N-pole region to an adjacent S-pole region. The magnetic blushes of the developer are formed along the lines of a magnetic force.

When the magnetic member 56 is partitioned into a first region (a rectangular region) 121 having the rear side 102 extending in the roller axial direction as a side downstream, and a second region 122 that is adjacent to the first region and close to the center of the developing roller 51 in the roller axial direction, the N-pole regions and the S-pole regions are distributed such that one pair of an N-pole region and an S-pole region is included in each of the first and second regions. Note that distribution of magnetic poles is not limited to this. For example, in the first region 121, it is preferable that at least one pair of the N-pole region and the S-pole region be included. The same applies to the magnetic member 57.

A length of the front side 101 (a width of a side located upstream) Wu and a length of the rear side 102 (a width of a side located downstream) Wd satisfy a relation Wd<Wu. In this embodiment, the width Wu is 5 [mm], and the width Wd is 2.5 [mm]. Wu is twice as large as Wd. Note that, needless to say, each width is not limited to the above.

As shown in FIG. 7B, the magnetic member 57 is identical to the magnetic member 56 with respect to an axis of symmetry. The dimensions and distribution of the N-pole regions and the S-pole regions in the magnetic member 57 are basically the same as those in the magnetic member 56.

As shown by a graph in FIG. 6 showing the distribution of a magnetic force, the developing roller 51 has a magnetic force that is uniform across a developing region having the developing width Dw along the roller axial direction. When the magnetic force at each position in the developing region is 100 [%], the magnetic force becomes smaller in the roller axial direction with distance from the developing region.

<Flow of Developer X>

With the above-mentioned structure, the developer X contained in the housing 50 is conveyed along the roller axial direction by the stirring member 53 and the supply member 52, thereby circulating in the housing 50. While circulating, the developer X is supplied to the developing roller 51 by the supply member 52. The developer X is supplied to the developing roller 51 by being held (carried) on the outer circumferential surface of the developing sleeve 511 by a magnetic force of the magnetic pole (a catch pole) S1 of the magnet roller 512 while being conveyed by the supply member 52.

The developer X held on the outer circumferential surface of the developing sleeve 511 is conveyed by the rotation of the developing sleeve 511 in a direction of big hollow arrows shown in FIG. 3. After the return member 55 increases the pressure applied to the conveyed developer X to some extent, the amount of the developer X passing through a gap between the restriction member 54 and the developing sleeve 511 is restricted by the restriction member 54. After passing through the magnetic poles N2 and S3, a given amount of the developer X is conveyed to a developing position facing the photosensitive drum 11.

At the developing position, a blush of the developer X is formed by the magnetic pole N4, and the developer X is supplied for developing an electrostatic latent image on the photosensitive drum 11. After being supplied for the development, the developer X having passed through the developing position is released from the magnetic force of the magnet roller 512 when passing through the magnetic pole S5, and collected by the supply member 52.

Note that the return member 55 guides the developer X that is blocked by the restriction member 54 and thus does not pass through the gap between the restriction member 54 and the developing sleeve 511 in a direction of small hollow arrows shown in FIG. 3. The developer X guided by the return member 55 in the direction of small hollow arrows shown in FIG. 3 is brought back to the supply member 52 along the inner surface 60 of the housing 50.

With the above-mentioned flow of the developer X, accumulation of the developer X having been blocked by the restriction member 54 is prevented in a region in the housing 50 located further upstream than the restriction member 54 and near the restriction member 54. Accordingly, it is possible to prevent an increase in pressure applied to carrier and toner particles caused by the accumulation of the developer X. Furthermore, it is also possible to prevent agglomeration of particles caused by the increase in pressure applied to carrier and toner particles.

The above-mentioned flow of the developer X is achieved in a region where the return member 55 is provided. At the ends of the developing region where the return member 55 is not provided, however, much of the developer X having not passed through the gap between the restriction member 54 and the developing sleeve 511 flows so as to escape into the ends of the developing region in the roller axial direction.

Specifically, as shown in FIG. 6, at the ends of the developing region, the developer X is conveyed along the second side 112 located inside the magnetic members 56 and 57 in the roller rotational direction (in a direction of big hollow arrows shown in FIG. 6). At the time, the magnetic members 56 and 57 restrict the movement of the developer X, and thus the developer X is prohibited from flowing toward the ends of the developing region in the roller axial direction. The restriction by the magnetic members 56 and 57 increases pressure applied to the developer X to some extent.

At the ends of the developing region, the developer X having been conveyed along the second side 112 reaches the position 113 where the second side 112 and the first side 111 meet each other before reaching the restriction member 54. At the position 113, the first side 111 is angled relative to the second side 112 toward an end of the developing region. Therefore, the developer X is freed from the restriction so as to flow toward the ends of the developing region. Furthermore, the pressure applied to the developer X having been conveyed along the second side 112 is eased. Therefore, a part of the developer X flows along the first side 111 (in a direction of small hollow arrows shown in FIG. 6).

The remaining developer X that does not flow along the first side 111 flows toward the restriction member 54. However, before reaching the restriction member 54 (at a position located further upstream than the restriction member 54 and near the restriction member 54), the developer X flowing toward the restriction member 54 joins the developer X that has been blocked by the restriction member 54 and thus has not passed through the gap between the restriction member 54 and the developing sleeve 511. A part of the joined developer X immediately passes through the gap between the restriction member 54 and the developing sleeve 511 and is conveyed to the developing position. Another part of the joined developer X is brought back upstream by the return member 55 as shown above. The other part of the joined developer X flows toward the ends of the developing region in the roller axial direction along the restriction member 54 (in a direction of thick solid arrows shown in FIG. 6).

Since the part of the joined developer X flowing toward the ends of the developing region joins the developer X flowing along the first side 111 at the ends of the developing region, the developer X is evenly distributed to the ends of the restriction member 54. With the above-mentioned flow of the developer X, the developer X is restricted by the restriction member 54 throughout a region corresponding to the developing region having the developing width Dw. After passing through the restriction member 54, a given amount of developer that is required for development is distributed to the developing region having the developing width Dw and conveyed to the developing position.

In this embodiment, in order to improve the flow of the developer X toward the ends of the developing region as mentioned above, a distance dm shown in FIG. 4 is made shorter toward the ends of the developing region. Here, the distance dm is a distance between an inner surface 79 of the housing 50 and the outer circumferential surface of the developing roller 51 (the outer circumferential surface of the developing sleeve 511).

The inner surface 79 of the housing 50 is a part of the inner surface 60 of the housing 50 which is located further downstream than the first side 111 of the magnetic member 56 in the roller rotational direction and on which the magnetic member 56 is not provided (a part where there is not the magnetic member 56 by providing the cut-out portion 86). The inner surface 79 is formed on a curved portion 71 that is located further downstream than the curved portion 72 (see FIG. 4) of the housing 50 and continues to the curved portion 72. The inner surface 79 is a sloping surface that slopes toward the rotational axis 513 of the developing roller 51 so that the distance dm between the inner surface 79 and the developing sleeve 511 becomes shorter toward the ends of the developing region in the roller axial direction. Hereinafter, the inner surface 79 is referred to as a "sloping surface 79".

The following describes how the distance dm between the sloping surface 79 and the outer circumferential surface of the developing sleeve 511 becomes shorter toward the ends of the developing region in the roller axial direction, with use of FIGS. 8 to 10.

FIG. 8 is a cross sectional view of the developing unit 14 at a position C shown in FIG. 6. FIG. 9 is a cross sectional view of the developing unit 14 at a position D shown in FIG. 6. FIGS. 10A and 10B each schematically show a change of the distance dm at each position in the roller axial direction. Note that, as shown in FIG. 6, the position B is obtained by shifting the second side 112 of the magnetic member 56 a little to the end of the developing region in the roller axial direction. The position D corresponds to the end of the developing region in the roller axial direction. The position C is between the positions B and D.

As can be seen from FIG. 4 showing the position B, FIG. 8 showing the position C and FIG. 9 showing the position D, the distance dm between the sloping surface 79 of the housing 50 and the outer circumferential surface of the developing roller 51 becomes shorter from the position B toward the position C, and becomes shorter from the position C toward the position D. Similarly, a distance dp between the first side 111 of the magnetic member 56 and the restriction member 54 in the roller rotational direction becomes shorter from the position B toward the position C, and becomes shorter from the position C toward the position D. Here, the distance dm at the position B is for example 2 [mm]. The distance dp at the position B is for example 4 [mm].

Note that, the distance dm shown in FIG. 9 is not a distance between the sloping surface 79 and the developing roller 51 but a distance between the magnetic member 56 and the developing roller 51.

This is because of the following reason. At a position between the positions C and D, the sloping surface 79 exists because there is the cut-out portion 86. At the position D, however, the sloping surface 79 does not exist because there is not the cut-out portion 86 and there is the magnetic member 56. However, the distance dm still becomes shorter from the position B toward the position C, and becomes shorter from the position C toward the position D. This can be seen also from FIG. 10.

FIG. 10A is a cross sectional view of the housing 50 taken along the line E-E' of FIG. 4. FIG. 10B is a plan view schematically showing the cut-out portion 86 corresponding to the sloping surface 79 shown in FIG. 10A. A positional relation between the cut-out portion 86 of the magnetic member 56 and the sloping surface 79 in the roller axial direction can be seen from FIGS. 10A and 10B.

As shown in FIG. 10A, the sloping surface 79 formed on the curved portion 71 of the housing 50 slopes toward the end of the developing region in the roller axial direction so that the sloping surface 79 becomes closer to the outer circumferential surface of the developing roller 51 toward the end of the developing region. At the position D, the sloping surface 79 stops sloping, and thus the sloping surface 79 ends at the position D. A part of the inner surface of the housing 50 where the sloping surface 79 is formed corresponds to a shaded region 99 shown in FIG. 10B.

As shown in FIGS. 10A and 10B, at the position D, the housing 50 is made thinner to provide the magnetic member 56 on the inner surface 60 thereof so that the rear side 102 of the magnetic member 56 continues to the sloping surface 79.

By forming the inner surface 60 of the housing 50 as shown above, the distance dm becomes shorter from the position B toward the position D. Specifically, as shown in FIG. 10A, when distances dmb, dmc and dmd respectively indicate the distances dm at the position B, position C and position D, the distances dmb, dmc and dmd satisfy a relation dmb>dmc>dmd.

By making the distance dm shorter toward the end of the developing region, the flow of the developer X in the roller axial direction and the sealing properties of the magnetic members 56 and 57 are improved. That is to say, as shown in FIG. 10A, since the distance dmb is long to some extent at the position B, the developer X (the developer flowing along the first side 111 of the magnetic member 56, and the developer restricted by the restriction member 54 and thus conveyed toward the end of the developing region in the roller axial direction) is likely to flow toward the position D (the end of the developing region) along the sloping surface 79.

The sloping surface 79 slopes so that the distance dm becomes shorter toward the position D, the amount of the developer X conveyed along the sloping surface 79 to the end of the developing region is restricted to some extent. With this restriction, the amount of the conveyed developer X becomes smaller toward the end of the developing region. However, the distance da between the restriction member 54 and the developing roller 51 is kept constant at any positions in the roller axial direction. In other words, although the amount of the conveyed developer X becomes smaller toward the end of the developing region, the distance da that restricts the amount of the developer X passing through each position in the roller axial direction (the developer targeted for the restriction by the restriction member 54) does not change. Therefore, a ratio of the amount of the conveyed developer X to the (constant) distance da at each position in the roller axial direction decreases closer to the end of the developing region.

At each position, the amount of developer passing through the gap having the distance da between the restriction member 54 and the developing roller 51 per unit time is the same. However, the amount of the developer X to be restricted by the restriction member 54 is smaller at the end of the developing region than at a center of the developing region.

This means that the amount of the developer X that is restricted by the restriction member 54 and thus does not pass through the gap between the restriction member 54 and the developing roller 51 is smaller at the end than at the center. This indicates that the pressure applied to the developer X per unit volume is lower at the end than at the center. When the pressure applied to the developer X is made lower at the end than at the center, the pressure applied to the developer X is made lower at both ends than at the center of the developing region. This prevents the leaking of the developer X through the magnetic members 56 and 57 to the outside in the roller axial direction, which is caused by an increase in pressure applied to the developer X. The sealing properties of the magnetic members 56 and 57 are improved.

In order to examine the effect of the sealing properties, an endurance printing test and a drop test were carried out. In the tests, the developer X did not leak from ends to the outside, and thus the effect of the sealing properties equivalent to that of the conventional structure was confirmed. Here, in the endurance printing test, 100 k (k=1000) copies of a document are actually printed. In the drop test, the developing unit is dropped about 0.9 [mm], assuming vibration during transportation.

<Comparison Between Embodiment and Comparative Example on Positional Relation Among Developing Width and Magnetic Members>

FIG. 11A is a schematic view showing a positional relation among the developing width Dw and the magnetic members in the roller axial direction in the embodiment. FIG. 11B is a schematic view showing a positional relation among the developing width Dw and the magnetic members in the roller axial direction in a comparative example.

As shown in FIG. 11A, the embodiment employs the magnetic members 56 and 57 respectively having the cut-out portions 86 and 87 at corners located downstream and inside. Each of the magnetic members 56 and 57 is positioned so as to overlap an end of the developing region having the developing width Dw in the roller axial direction.

In the comparative example shown in FIG. 11B, rectangular magnetic members 96 and 97 are positioned outside the developing region so as not to overlap the developing region. Each of the magnetic members 96 and 97 does not have the cut-out portion at a corner located downstream and inside. The width of each of the magnetic members 96 and 97 is equal to the width Wu of each of the magnetic members 56 and 57.

The following describes the reason why the magnetic members 96 and 97 are positioned so as not to overlap the developing region in the comparative example. If the magnetic members 96 and 97 are positioned so as to overlap the developing region, the sealing properties of the magnetic members 96 and 97 are exhibited even in areas of the developing region that overlap the magnetic members 96 and 97. Therefore, the developer X may not flow to the areas of the developing region that overlap the magnetic members 96 and 97, and thus the developer X may not be distributed to both ends of the developing region. This makes it difficult to perform development in the entire developing region.

On the other hand, in the embodiment, the magnetic members 56 and 57 respectively have the cut-out portions 86 and 87 at corners located downstream and inside. With the cut-out portions 86 and 87, the developer X is guided to both ends of the developing region as described above. Even when the magnetic members 56 and 57 are provided so as to overlap the developing region, the developer X is distributed to both ends of the developing region, and the development is appropriately performed, in contrast to the comparative example.

The magnetic members 56 and 57 respectively have the cut-out portions 86 and 87 at corners located downstream. Each of the magnetic members 56 and 57 has the width Wu that is large enough to exhibit the sealing properties at areas located further upstream than the cut-out portions 86 and 87. Since each width of the cut-out portions 86 and 87 is smaller than the width Wu, the sealing properties naturally decrease at the cut-out portions 86 and 87. However, the developer X is gradually guided to both ends of the developing region along the cut-out portions 86 and 87. Therefore, the sealing properties do not decrease to the extent that the developer X leaks to the outside, even if the magnetic member becomes narrower toward a downstream side.

In terms of miniaturization of a device, by providing the magnetic members 56 and 57 so as to overlap the developing region, the magnetic members 56 and 57 are made closer to the center of the developing region in the roller axial direction in the embodiment without reducing the developing width Dw, compared with those in the comparative example. Accordingly, a length La of the developing roller 51 in the roller axial direction is made shorter than a length Lb of a developing roller 91 in the comparative example in the roller axial direction.

The developing roller 51 is the main member of the developing unit 14. Therefore, dimensions and shapes of the other members such as the housing 50 and the supply member 52 are generally determined based on the dimensions and shapes of the developing roller 51. By reducing the length of the developing roller 51 in the roller axial direction, the length of the developing unit 14 in the roller axial direction is reduced. Therefore, it becomes possible to achieve miniaturization of the device.

Note that, in comparative example, in order to reduce the length of the developing roller 51 in the roller axial direction, it is considered to reduce an overall width of each of the magnetic members 96 and 97. With this structure, however, the sealing properties are significantly decreased as shown above, and thus the leaking of the developer might not be prevented.

As set forth the above, in the embodiment, by using the magnetic members 56 and 57 respectively having the cut-out portions 86 and 87 at corners located downstream and inside, the developing unit 14 and even the apparatus as a whole can be reduced in size without decreasing the development performance and the sealing properties (while retaining the development performance and the sealing properties).

Also, by reducing the length of the developing roller 51 in the roller axial direction, the amount of materials used to make the developing roller 51, such as aluminum and a magnet, can be reduced, thereby reducing the cost.

Furthermore, in the embodiment, the length of the developing roller 51 is reduced on the assumption that the developing width Dw cannot be reduced. However, the assumption is not limited to this. For example, the developing width Dw is increased on the assumption that the length of the developing roller 51 cannot be reduced.

That is to say, with the conventional structure in which two magnetic members are positioned outside the developing region in the roller axial direction so that the developing region is between the two magnetic members, in order to increase the developing width Dw, the developing roller 51 have to be increased in length while maintaining the positional relation among the developing region and the magnetic members.

On the other hand, with the structure in the embodiment in which the magnetic members are positioned so as to overlap respective ends of the developing region in the roller axial direction, the developing width Dw is increased by a total width of the cut-out portions 86 and 87 in the roller axial direction (i.e. $2\times(Wu-Wd)$) without reducing the length of the developing roller 51 (while maintaining the length), compared with the conventional structure.

There may be a user who hopes to use a nonstandard sheet such as a full-bleed A3 sheet, which is a sheet a little larger than an A3 sheet. In order to meet the needs of such a user, it is required to increase the developing width Dw so as to be compliant with a full-bleed A3 size.

With the conventional structure, in order to increase the developing width Dw so as to be compliant with the full-bleed A3 size, the length of the developing roller have to be increased accordingly.

With the structure in the embodiment, the developing width Dw is increased by a total width of the cut-out portions 86 and 87. When the total width of the cut-out portions 86 and 87 is equal to or larger than a difference between the width of the A3 sheet and the width of the full-bleed A3 sheet, the developing width Dw is increased so as to be compliant with the full-bleed A3 size without increasing the length of the developing roller further than the width compliant with an A3 size. Therefore, it becomes possible to respond to the needs of the user who hopes to use the full-bleed A3 sheet without increasing the device/apparatus in size.

Specifically, when the magnetization width of the magnet roller 512 included in the developing roller 51 is 314 [mm], the developing width Dw of 313.5 [mm] is ensured while retaining the sealing properties, without increasing the developing roller in length as shown in FIG. 11B. This enables to print a crop mark (a mark indicating an area of the A3 size) corresponding to the full-bleed A3 size on a sheet.

Note that, when the total width of the cut-out portions 86 and 87 is smaller than the difference between the width of the A3 sheet and the width of the full-bleed A3 sheet, it is required to increase the length of the developing roller further than the width compliant with the A3 size. In this case, however, the increased length of the developing roller is made shorter, compared with the conventional structure. Therefore, it is possible to reduce the size and the cost of the device/apparatus, compared with the conventional structure.

<Modifications>

Although the present invention has been described based on the embodiment, it is obvious that the present invention is not limited to the above-mentioned embodiment, and various modifications may be implemented.

(1) In the embodiment, although a side of each of the cut-out portions 86 and 87 is a diagonal (straight) line in a plan view, the side is not limited to this. The side may have any shape as long as the developer X is guided in the roller rotational direction while being sealed at a position located further upstream than the cut-out portion, and the cut-out portion guides the developer X to both ends of the developing region. In other words, the side may have any shape as long as the cut-out portion is set back to an end of the developing region (from the center of the developing roller 51) closer to the downstream end of the magnetic member.

FIGS. 12A and 12B are plan views respectively showing structures of magnetic members 81 and 82 in modification.

As shown in FIGS. 12A and 12B, the magnetic members 81 and 82 respectively have the cut-out portions 86 and 87, each of which has an L-shape formed by cutting out, from a rectangle, a corner located downstream and inside at approximately a right angle. The magnetic members 81 and 82 respectively correspond to the magnetic members 56 and 57 having structures in each which the angle θ formed by the first side 111 relative to a direction perpendicular to the roller axial direction is 90[20 ].

With such a structure, it is possible to guide the developer X in the roller rotational direction at the second side 112, and to guide the developer X to both ends of the developing region at the first side 111.

(2) The magnetic member may have a structure shown in each of FIGS. 13A, 13B and 13C. The magnetic member 83 shown in FIG. 13A has the cut-out portion 86 whose side is a zigzag line. The magnetic member 84 shown in FIG. 13B has the cut-out portion 86 whose side is a concave curved line. The magnetic member 85 shown in FIG. 13C has the cut-out portion 86 whose side is a convex curved line. With any of these structures, the developer X is guided to both ends of the developing region.

A suitable shape of the magnetic member is determined in an experiment and the like, according to the shapes and dimensions of the housing 50, the developing roller 51 and so on, the types of the developer X (e.g. size and material of carrier and toner, and a ratio of carrier to toner), and so on.

Shapes of parts of the magnetic members 56 and 57 respectively located further upstream than the cut-out portions 86 and 87 (i.e. the side 103 and the second side 112) are not limited to those described in the embodiment. In the embodiment, the side 103 and the second side 112 are both perpendicular to the roller axial direction. However, the side 103 and the second side 112 may be a little curved. Note that, in order to reduce the size of a device in the roller axial direction while retaining the sealing properties, it is especially desirable that the side 103 be a straight line in a plan view.

Furthermore, in the embodiment, although the rear side 102 of each of the magnetic members 56 and 57 is in contact with the restriction member 54 (see FIGS. 6 and 9), a positional relation among magnetic members and the restriction member 54 is not limited to this. The magnetic member may be positioned so as to have a gap with the restriction member 54 to the extent that the sealing properties are retained.

Also, although the magnetic flux (T) of each of the magnetic members 56 and 57 per unit area may be uniform across a magnetic member, the magnetic flux is not limited to this. For example, it is possible to improve the sealing properties at the downstream ends of the magnetic members 56 and 57 by making the magnetic flux at the downstream ends of the magnetic members 56 and 57, at which the cut-out portions 86 and 87 are respectively formed, larger than that at the upstream ends thereof.

(3) In the embodiment, although the magnetic members 56 and 57 are respectively provided at both ends of the developing region, the positions where the magnetic members 56 and 57 are provided are not limited to the both ends of the developing region. For example, the magnetic member having a cut-out portion at a corner located downstream and inside may be provided at only one of the ends.

Depending on a direction of the air current, it is considered that there is a device having a structure in which the toner floating around the developing roller 51 is likely to flow toward only one of the ends of the developing roller 51. In such a device, the leaking of the floating toner from the developing unit 14 is prevented by providing the magnetic member at only the one end of the developing roller 51.

In this case, at the other end, a magnetic member having the conventional structure may be provided, or the magnetic member may not be provided if it is not necessary. Alternatively, the magnetic member having the structure shown in the embodiment may be provided.

(4) In the embodiment, in order to guide the developer X to both ends of the developing region, the sloping surface is formed at a part of the inner surface 60 of the housing 50 corresponding to each of the cut-out portions 86 and 87 (i.e. the shaded region 99 shown in FIG. 10B where there is not the magnetic member 56 by providing the cut-out portion 86). The sloping surface slopes so that the distance dm between the sloping surface and the outer circumferential surface of the developing roller 51 becomes shorter toward an end of the developing region in the roller axial direction (when cutting along the roller axial direction, the sloping surface is linear in cross section). However, the structure of the sloping surface is not limited to this.

As long as the liquidity of the developer X is increased, the inner surface 60 of the housing 50 may have a surface that has a curved or step-like shape in cross section, in place of the sloping surface. Alternatively, the sloping surface 79 does not have to be formed at the entire region 99. For example, the sloping surface 79 may be formed at a half of the region 99 close to an end of the developing region.

Furthermore, the inner surface 60 of the housing 50 may not have the sloping surface 79. Depending on the structure of the developing unit 14, without forming the sloping surface 79, the first side 111 of each of the magnetic members 56 and 57 guides the developer X so that the developer X flows to the entire developing region along the first side 111. The same applies to the return member 55. The return member 55 may not be provided.

(5) In the embodiment, the restriction member 54 is provided to the housing 50 to restrict the amount of developer X conveyed to the developing position in the roller rotational direction. However, when the housing 50 is made of a resin, for example, the housing and the restriction member may be integrally formed.

(6) In the embodiment, the developing device according to the present invention is applied to a tandem-type color digital printer. However, the developing device according to the present invention may be applied to, regardless of color or monochrome image formation, a developing device in which the developer is conveyed to the developing position while being held on the outer circumferential surface of a developer carrier such as the developing roller, and an electrostatic latent image formed on an image carrier such as a photosensitive drum and a photosensitive belt is developed at the developing position. Alternatively, the developing device according to the present invention may be applied to an image forming apparatus, such as a copying machine, a facsimile machine, and an MFP (Multiple Function Peripheral), including the developing device.

As an example of the developer carrier, the developing roller 51 including the cylindrical developing sleeve 511 and the fixed magnet roller 512 inserted into the developing sleeve 511 is described. However, the developer carrier is not limited to the developing roller 51. The developer carrier may be any member as long as the developer carrier rotates while holding the developer X on the outer circumferential surface thereof.

Also, although the two-component developer is used as the developer, the developer is not limited to the two-component developer as long as the developer includes particles with magnetic properties. For example, mono-component developer only including toner may be used. Note that, the mono-component developer only including toner is developer that does not include carrier, and may include an additive agent and the like. In the embodiment, the photosensitive drum 11 and the developing unit 14 are unitized as an imaging unit 19 that is configured to be detachable from a device body, the structure of the developing device is not limited to this.

The embodiment and the modifications described above may be combined one another if at all possible.

<Conclusion>

Each of the embodiment and modifications shown above is an aspect of the present invention to solve the problems discussed in the section of RELATED ART. The embodiment and modifications shown above are summarized as follows.

(1) A developing device that develops a latent image on an image carrier with use of developer including particles with magnetic properties, the developing device comprising: a developer carrier that is provided so as to face the image carrier, and configured to rotate while magnetically holding the developer on an outer circumferential surface thereof; and a magnetic member that is elongated along a rotational direction of the developer carrier so as to surround the outer circumferential surface of the developer carrier with a gap therebetween, wherein when viewed from a direction perpendicular to a rotational axis of the developer carrier, the magnetic member overlaps an end of a developing region of the developer carrier in a direction of the rotational axis, and when a side of the magnetic member close to a center of the developer carrier in the direction of the rotational axis is divided into a first side located downstream in the rotational direction and a second side located upstream in the rotational direction, the first side is set back further from the center of the developer carrier than a position where the first and second sides meet each other.

(2) The developing device of (1), wherein in a plan view, the magnetic member has a shape formed by cutting out, from a rectangle, a corner located downstream in the rotational direction and close to the center of the developer carrier, and the first side corresponds to a cut edge of the magnetic member.

(3) The developing device of (2), wherein in a plan view, the magnetic member has a shape formed by cutting out the corner in a straight line or has an L-shape formed by cutting out the corner at approximately a right angle.

(4) The developing device of (1), wherein in a plan view, the first side is one of straight, zigzag and curved lines, and the second side is a line perpendicular to the direction of the rotational axis.

(5) The developing device of (1), further comprising a housing in which the developer carrier is rotatably held, and that has an opening from which the developer carrier is partially exposed to the outside so as to face the image carrier, wherein the magnetic member is provided on an inner surface of the housing, and a distance dm between a part of an inner surface of the housing and the outer circumferential surface of the developer carrier is shorter, than at a first position, at a second position, the second position being located closer to the overlapped end of the developing region than the first position in the direction of the rotational axis, the part of the inner surface of the housing being a part which is located further downstream than the first side in the rotational direction and on which the magnetic member is not provided.

(6) The developing device of (5), wherein the part of the inner surface of the housing includes a sloping surface sloping toward the rotational axis so that the sloping surface becomes closer to the outer circumferential surface of the developer carrier from the first position toward the second position.

(7) The developing device of (1), wherein the magnetic member has a rear side being located downstream in the rotational direction and meeting the first side on the overlapped end of the developing region.

(8) The developing device of (1), wherein the magnetic member is formed by alternately arranging N-pole regions and S-pole regions in the direction of the rotational axis, the N-pole and S-pole regions each being elongated along the rotational direction.

(9) The developing device of (8), wherein the magnetic member has a rear side extending from a downstream end of the first side along the rotational axis so as to be away from the center of the developer carrier, and in a plan view, the magnetic member includes at least one pair of an N-pole region and an S-pole region in a rectangular area having the rear side as a side located downstream in the rotational direction.

(10) The developing device of (1), wherein a pair of the magnetic members overlap respective both ends of the developing region of the developer carrier in the direction of the rotational axis.

(11) The developing device of (1), further comprising a magnet inserted in the developer carrier and extending along the rotational axis so as to correspond to the image carrier, wherein a width of the developing region is equal to a length of the magnet in the direction of the rotational axis.

(12) The developing device of (1), wherein the developer is one of two-component developer and mono-component developer, the two-component developer including carrier as the particles with magnetic properties and toner, and the mono-component developer including only toner as the particles with magnetic properties.

(13) An imaging unit that is detachable from a body of an image forming apparatus, comprising: an image carrier on which a latent image is formed; and a developing unit configured to develop the latent image with use of developer including particles with magnetic properties, wherein the developing unit includes: a developer carrier that is provided so as to face the image carrier, and configured to rotate while magnetically holding the developer on an outer circumferential surface thereof; and a magnetic member that is elongated along a rotational direction of the developer carrier so as to surround the outer circumferential surface of the developer carrier with a gap therebetween, when viewed from a direction perpendicular to a rotational axis of the developer carrier, the magnetic member overlaps an end of a developing region of the developer carrier in a direction of the rotational axis, and when a side of the magnetic member close to a center of the developer carrier in the direction of the rotational axis is divided into a first side located downstream in the rotational direction and a second side located upstream in the rotational direction, the first side is set back further from the center of the developer carrier than a position where the first and second sides meet each other.

(14) An image forming apparatus that includes a developing unit for developing a latent image on an image carrier with use of developer including particles with magnetic properties, wherein the developing unit includes: a developer carrier that is provided so as to face the image carrier, and configured to rotate while magnetically holding the developer on an outer circumferential surface thereof; and a magnetic member that is elongated along a rotational direction of the developer carrier so as to surround the outer circumferential surface of the developer carrier with a gap therebetween, when viewed from a direction perpendicular to a rotational axis of the developer carrier, the magnetic member overlaps an end of a developing region of the developer carrier in a direction of the rotational axis, and when a side of the magnetic member close to a center of the developer carrier in the direction of the rotational axis is divided into a first side located downstream in the rotational direction and a second side located upstream in the rotational direction, the first side is set back further from the center of the developer carrier than a position where the first and second sides meet each other.

With the above-mentioned structure, the magnetic members are provided at positions close to the center of the developer carrier in the axial direction thereof. This structure reduces the length of the developer carrier in the axial direction while preventing the floating toner from leaking, and thereby achieves miniaturization of a developing device.

INDUSTRIAL APPLICABILITY

The developing device according to the present invention is a developing device that performs development with use of developer including particles with magnetic properties. The present invention is useful as a technology to reduce a size of a device in which the developer is sealed using a magnetic member.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A developing device that develops a latent image on an image carrier with use of developer including particles with magnetic properties, the developing device comprising:

a developer carrier that is provided so as to face the image carrier, and configured to rotate while magnetically holding the developer on an outer circumferential surface thereof; and a magnetic member that is elongated along a rotational direction of the developer carrier so as to surround the outer circumferential surface of the developer carrier with a gap therebetween, wherein when viewed from a direction perpendicular to a rotational axis of the developer carrier, the magnetic member overlaps an end of a developing region of the developer carrier in a direction of the rotational axis, and when a side of the magnetic member close to a center of the developer carrier in the direction of the rotational axis is divided into a first side located downstream in the rotational direction and a second side located upstream in the rotational direction, the first side is set back further from the center of the developer carrier than a position where the first and second sides meet each other.

2. The developing device of claim 1, wherein in a plan view, the magnetic member has a shape formed by cutting out, from a rectangle, a corner located downstream in the rotational direction and close to the center of the developer carrier, and the first side corresponds to a cut edge of the magnetic member.

3. The developing device of claim 2, wherein in a plan view, the magnetic member has a shape formed by cutting out the corner in a straight line or has an L-shape formed by cutting out the corner at approximately a right angle.

4. The developing device of claim 1, wherein in a plan view, the first side is one of straight, zigzag and curved lines, and the second side is a line perpendicular to the direction of the rotational axis.

5. The developing device of claim 1, further comprising a housing in which the developer carrier is rotatably held, and that has an opening from which the developer carrier is partially exposed to the outside so as to face the image carrier, wherein the magnetic member is provided on an inner surface of the housing, and a distance dm between a part of an inner surface of the housing and the outer circumferential surface of the developer carrier is shorter, than at a first position, at a second position, the second position being located closer to the overlapped end of the developing region than the first position in the direction of the rotational axis, the part of the inner surface of the housing being a part which is located further downstream than the first side in the rotational direction and on which the magnetic member is not provided.

6. The developing device of claim 5, wherein the part of the inner surface of the housing includes a sloping surface sloping toward the rotational axis so that the sloping surface becomes closer to the outer circumferential surface of the developer carrier from the first position toward the second position.

7. The developing device of claim 1, wherein the magnetic member has a rear side being located downstream in the rotational direction and meeting the first side on the overlapped end of the developing region.

8. The developing device of claim 1, wherein the magnetic member is formed by alternately arranging N-pole regions and S-pole regions in the direction of the rotational axis, the N-pole and S-pole regions each being elongated along the rotational direction.

9. The developing device of claim 8, wherein the magnetic member has a rear side extending from a downstream end of the first side along the rotational axis so as to be away from the center of the developer carrier, and in a plan view, the magnetic member includes at least one pair of an N-pole region and an S-pole region in a rectangular area having the rear side as a side located downstream in the rotational direction.

10. The developing device of claim 1, wherein a pair of the magnetic members overlap respective both ends of the developing region of the developer carrier in the direction of the rotational axis.

11. The developing device of claim 1, further comprising a magnet inserted in the developer carrier and extending along the rotational axis so as to correspond to the image carrier, wherein a width of the developing region is equal to a length of the magnet in the direction of the rotational axis.

12. The developing device of claim 1, wherein the developer is one of two-component developer and mono-component developer, the two-component developer including carrier as the particles with magnetic properties and toner, and the mono-component developer including only toner as the particles with magnetic properties.

13. An imaging unit that is detachable from a body of an image forming apparatus, comprising:

an image carrier on which a latent image is formed; and a developing unit configured to develop the latent image with use of developer including particles with magnetic properties, wherein the developing unit includes:

a developer carrier that is provided so as to face the image carrier, and configured to rotate while magnetically holding the developer on an outer circumferential surface thereof; and a magnetic member that is elongated along a rotational direction of the developer carrier so as to surround the outer circumferential surface of the developer carrier with a gap therebetween, when viewed from a direction perpendicular to a rotational axis of the developer carrier, the magnetic member overlaps an end of a developing region of the developer carrier in a direction of the rotational axis, and when a side of the magnetic member close to a center of the developer carrier in the direction of the rotational axis is divided into a first side located downstream in the rotational direction and a second side located upstream in the rotational direction, the first side is set back further from the center of the developer carrier than a position where the first and second sides meet each other.

14. An image foaming apparatus that includes a developing unit for developing a latent image on an image carrier with use of developer including particles with magnetic properties, wherein the developing unit includes:

a developer carrier that is provided so as to face the image carrier, and configured to rotate while magnetically holding the developer on an outer circumferential surface thereof; and a magnetic member that is elongated along a rotational direction of the developer carrier so as to surround the outer circumferential surface of the developer carrier with a gap therebetween, when viewed from a direction perpendicular to a rotational axis of the developer carrier, the magnetic member overlaps an end of a developing region of the developer carrier in a direction of the rotational axis, and when a side of the magnetic member close to a center of the developer carrier in the direction of the rotational axis is divided into a first side located downstream in the rotational direction and a second side located upstream in the rotational direction, the first side is set back further from the center of the developer carrier than a position where the first and second sides meet each other.

* * * * *